US006334822B1

(12) United States Patent
Zider

(10) Patent No.: US 6,334,822 B1
(45) Date of Patent: Jan. 1, 2002

(54) DEFLECTABLE BASKETBALL HOOP

(76) Inventor: Grant T. Zider, 125 Deer Meadow La., Portola Valley, CA (US) 94028-7608

( * ) Notice: Subject to any disclaimer, the term of this patent is extended or adjusted under 35 U.S.C. 154(b) by 0 days.

(21) Appl. No.: 09/578,203

(22) Filed: May 24, 2000

(51) Int. Cl.[7] ..... A63B 63/08
(52) U.S. Cl. ..... 473/479
(58) Field of Search ..... 473/415, 175, 473/446, 481, 486, 447, 466, 476, 479

(56) References Cited

U.S. PATENT DOCUMENTS

| | | | | |
|---|---|---|---|---|
| 2,818,254 A | | 12/1957 | Dunn | |
| 3,743,286 A | | 7/1973 | Weinhagen et al. | |
| 4,365,802 A | | 12/1982 | Ehrat | |
| 4,441,709 A | | 4/1984 | Schroeder et al. | |
| 5,149,086 A | | 9/1992 | Ziff | |
| 5,154,414 A | | 10/1992 | Auer et al. | |
| 5,542,679 A | * | 8/1996 | Caso | 473/446 |
| 5,888,153 A | * | 3/1999 | Masin | 473/175 |

* cited by examiner

*Primary Examiner*—Paul T. Sewell
*Assistant Examiner*—M. Chambers
(74) *Attorney, Agent, or Firm*—Burns Doane Swecker & Mathis, L.L.P.

(57) ABSTRACT

A pivoting breakaway basketball hoop reduces player injury and prevents damage to the hoop by deflecting in multiple directions. The basketball hoop includes a rim which is supported on a rim support member by a joint such as flexible coupling or universal joint. The joint allows the rim to deflect in multiple directions and returns the rim to its original position. The basketball hoop also may include a counter balance and/or a stop which help to return the rim to its original position.

11 Claims, 2 Drawing Sheets

DEFLECTABLE BASKETBALL HOOP

BACKGROUND OF THE INVENTION

1. Field of the Invention

The invention relates to a basketball hoop, and more particularly, the invention relates to a deflectable basketball hoop which prevents injury to players and is less likely to break.

2. Brief Description of the Related Art

Many of the basketball hoops which are currently on the market have rims which are rigidly fixed to the backboard. These rigid rims may break easily or cause injury to players when slam-dunking. One solution to the rigid rim problem is the breakaway rim. Breakaway rims such as those described in U.S. Patent Nos. 4,365,802; 4,441,709; and 5,154,414 are provided with a hinge connecting the rim to the backboard which allows the rim to pivot downward upon the application of potentially damaging forces. These breakaway rims operate quite successfully to prevent rim breakage and player injury when the rims are pulled straight downward. However, when forces are applied to the rims in other directions, breakage or injury may occur.

For example, a player may approach the basketball hoop from the side and slam dunk grasping a side of the rim and pulling sideways and downward. The sideways force on the rim may result in a broken backboard or injured player if a conventional breakaway rim is used.

Accordingly, it would be desirable to provide a basketball hoop having a breakaway rim which is able to be deflected in multiple directions.

SUMMARY OF THE INVENTION

The present invention relates to a deflectable basketball hoop having a rim which is supported by a joint such as a spring or universal joint with at least two degrees of freedom.

In accordance with one aspect of the present invention, a deflectable basketball hoop includes a rim, a rim support member, and a joint connecting the rim to the rim support member, the joint providing the rim with at least two degrees of freedom with respect to the rim support member.

In accordance with an additional aspect of the present invention, a deflectable basketball hoop includes a rim supported by a joint which allows the rim to be deflected in multiple non-parallel directions.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

The basketball hoop according to the present invention is a pivoting breakaway hoop which reduces player injury and hoop breakage. The breakaway rim deflects in multiple directions and returns to its original position. The basketball hoop also may include a counter balance and/or a stop which help to return the hoop to its original position.

Figure 1:
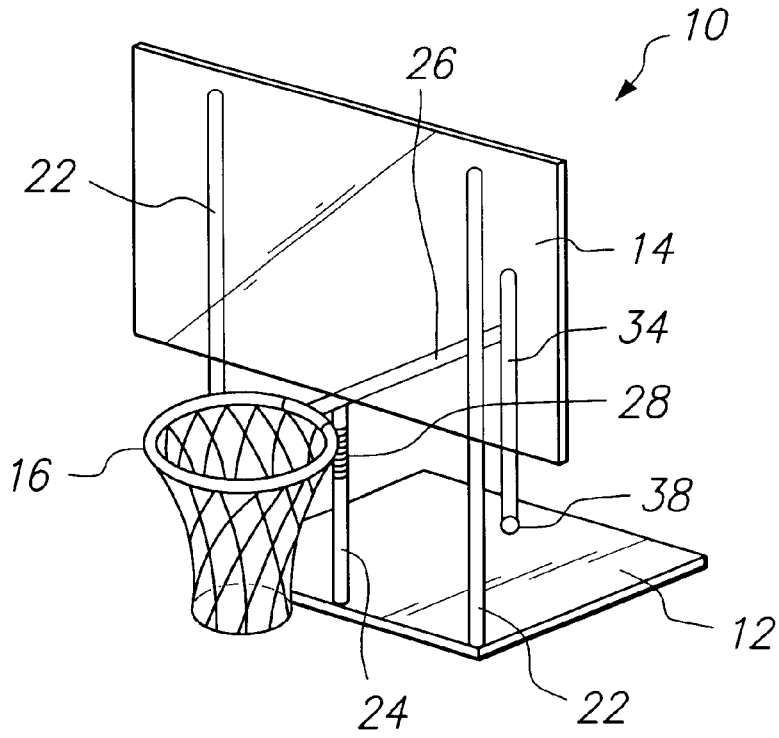
FIG. 1 is a perspective view of a first embodiment of the basketball hoop.

FIG. 1 illustrates the basketball hoop 10 including a base 12, a backboard 14, and a rim 16. The backboard 14 is supported on the base 12 by two backboard supports 22. The rim 16 is also supported on the base 12 by a vertical tube 24 and a horizontal tube 26 which are connected by a spring element 28.

Figure 2:
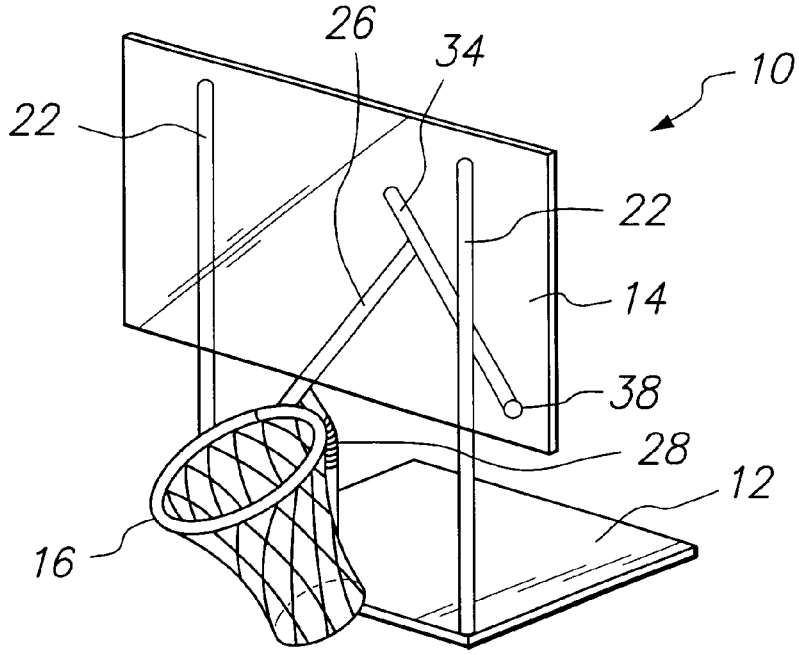
FIG. 2 is a perspective view of the basketball hoop of FIG. 1 with the rim in a deflected position.

As shown in FIG. 2, the rim 16 can be deflected in any direction when a force is applied due to the flexibility of the joint 28. The joint 28 in the embodiment of FIG. 1 is a spring element, however, other types of joints may also be used. The spring element 28 allows the rim to be deflected and also returns the rim 16 to its initial position after a force has been removed. The spring element 28 returns the rim to its original position quickly so that the rim is back in a proper orientation for the next shot and the game is not interrupted.

Figure 3:
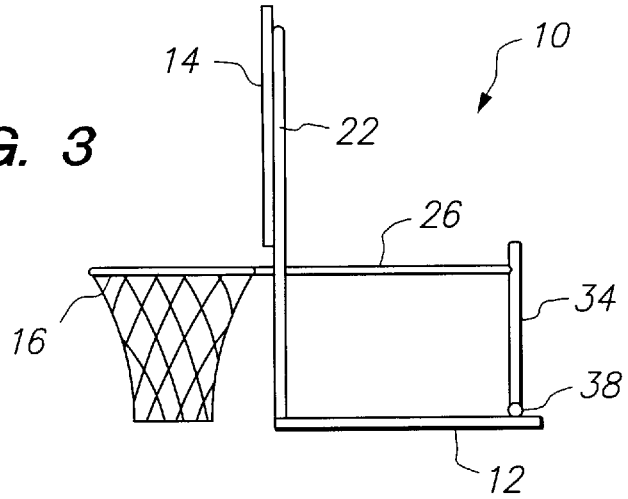
FIG. 3 is a side view of the basketball hoop of FIG. 1.

As shown in FIGS. 1–3 the basketball hoop 10 includes a counter balance which is formed from the horizontal tube 26 and a connected vertical tube 34. The weight of these two tubes 26, 34 counter balances the weight of the rim 16 and helps to return the rim to its original position more quickly.

The embodiment of FIGS. 1–3 also includes a stopper 38 provided on the lower end of the vertical tube 34. When the stopper 38 on the bottom of the vertical tube 34 contacts the base 12 the original position of the rim 16 is maintained and oscillation of the rim is prevented. The position of the stop 38 adjacent the base 12 when the rim is horizontal is shown most clearly in the side view of FIG. 3.

Figure 4:
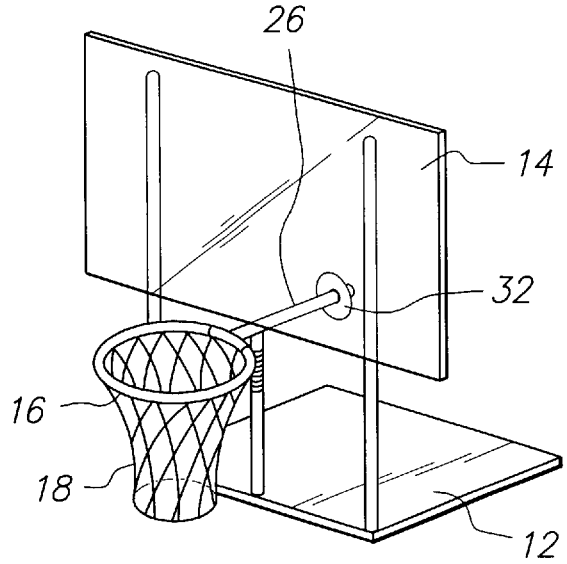
FIG. 4 is a perspective view of an alternative embodiment of a basketball hoop.

FIG. 4 illustrates an alternative embodiment of the invention in which the counter balance is formed from a disc shaped weight 32 which is positioned on an end of the horizontal tube 26. The weight of the counter balance disc 32 is selected so that the weight of the horizontal tube 26 and the disc at one side of the spring element 26 is substantially the same as the weight of the rim 16, net 18, and portion of the horizontal tube 36 on the other side of the spring element 28.

FIGS. 1–4 illustrate embodiments of the invention in which the basketball hoop 10 is a pool side basketball hoop 10. With the pool side basketball hoop 10 the base 12 is placed on the ground at a side of the pool with the rim 16 hanging over the edge of the pool. However, it should be understood that the basketball hoop according to the present invention can also be mounted on any conventional pole or other mounting system for basketball hoops.

Figure 5:
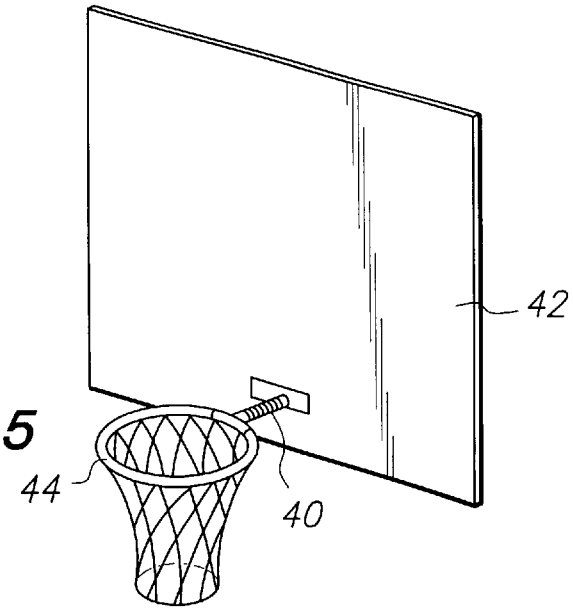
FIG. 5 is a perspective view of further alternative embodiment of a basketball hoop.

FIG. 5 illustrates an alternative embodiment of the basketball hoop in which a spring element 40 is mounted on a backboard 42 and supports a rim 44 in a breakaway arrangement. According to this embodiment, the backboard 42 acts as a support member for the rim 44. Alternatively, a wall, a pole, or the like can also provide a support for the rim.

FIG. 6 illustrates an embodiment of the basketball hoop in which the joint 50 between the vertical tube 24 and the horizontal tube 26 is a universal joint or ball joint. The universal joint 50 allows the rim 16 to be deflected in a plurality of directions while spring elements 52 return the rim 60 to an original position. The spring elements 52 are connected to a back end of the horizontal tube 26 and to rear corners of the base 12. The spring elements 52 may be any known spring element such as stainless steel springs, rubber straps, or the like.

The basketball hoop of FIG. 6 preferably includes a stop feature to prevent or reduce oscillations. The stop may be provided within the universal joint, attached to the horizontal tube 26, or in any other known manner.

The rim 16, backboard 14, and supports according to the present invention may be formed of conventional materials such as stainless steel, other alloys, plastic, and the like. The spring element 28, 44 may be any type of flexible coupling such as a stainless steel spring, a rubber tube, a superelastic band, rod, or tube, or the like.

The flexibility of the spring element may be varied from a very stiff spring which is deflected only by the player when slam dunking to a very flexible spring which can be deflected by the ball and thus makes it more difficult to make a basket.

According to one embodiment of the invention, a pool side basketball hoop 10 is formed with a backboard 14 of a flexible plexiglass material. The flexibility of the plexiglass material deadens the bounce of the ball. The amount of deadening may be selected by the choice of plexiglass material. The ball deadening feature may also be provided by using a rigid backboard with a soft deadening washer between the backboard 14 and the supports 22. Alternatively, the ball deadening feature may be provided by flexible backboard supports of by other know means.

Although a single joint or spring element 28, 44, 50 has been illustrated, it should be recognized that multiple joints or spring elements may also be used and will still provide multiple degrees of freedom.

While the invention has been described in detail with reference to the preferred embodiments thereof, it will be apparent to one skilled in the art that various changes and modifications can be made and equivalents employed, without departing from the present invention.

What is claimed is:

1. A deflectable basketball hoop comprising:

a rim supported on a substantially horizontal member;

a rim support member;

a backboard;

a joint connecting the rim to the rim support member, the joint providing the rim with at least two perpendicular degrees of freedom with respect to tho rim support member and with respect to the backboard; and a counter balance connected to the substantially horizontal member and positioned to return the rim to a substantially horizontal position.

2. The deflectable basketball hoop of claim 1, further comprising a spring for returning the rim to a substantially horizontal position.

3. The deflectable basketball hoop of claim 1, wherein the joint is a spring.

4. The deflectable basketball hoop of claim 1, wherein the joint is a rubber member.

5. The deflectable basketball hoop of claim 1, the rim support member is a substantially vertical member, and the joint is positioned between the substantially horizontal member and the substantially vertical rim support nember.

6. The deflectable basketball hoop of claim 5, further comprising a stop member for stopping the rim in the substantially horizontal position.

7. The deflectable basketball hoop of claim 1, wherein the joint allows the rim to pivot forward when a force is applied to a front portion of the rim and allows the rim to pivot sideways when a force is applied to a side portion of the rim.

8. The deflectable basketball hoop of claim 1, wherein the deflectable basketball hoop is a pool side basketball hoop and the rim support member is positioned on a base which is arranged to be positioned on a side of the pool.

9. The deflectable basketball hoop of claim 1, further comprising a flexible backboard which deadens the bounce of the ball.

10. The deflectable basketball hoop of claim 9, wherein flexible backboard is made of plexiglass.

11. The deflectable basketball hoop of claim 1, wherein the backboard deadens the bounce of the ball.

* * * * *